US006149042A

United States Patent [19]

Rassias

[11] Patent Number: 6,149,042

[45] Date of Patent: Nov. 21, 2000

[54] SECURITY AND DEPLOYMENT SYSTEM

[76] Inventor: John N. Rassias, 7700 Cedarwood Cir., Boca Raton, Fla. 33434

[21] Appl. No.: 09/297,552

[22] PCT Filed: Nov. 4, 1997

[86] PCT No.: PCT/US97/20120

§ 371 Date: May 3, 1999

§ 102(e) Date: May 3, 1999

[87] PCT Pub. No.: WO98/20293

PCT Pub. Date: May 14, 1998

Related U.S. Application Data

[60] Provisional application No. 60/030,132, Nov. 4, 1996.

[51] Int. Cl.[7] ..... A45F 5/00

[52] U.S. Cl. ..... 224/661; 224/243; 224/901.4; 224/907; 224/911; 224/912

[58] Field of Search ..... 224/192, 198, 224/243, 624, 661, 901.4, 907, 911, 912; 42/70.11

[56] References Cited

U.S. PATENT DOCUMENTS

| | | | |
|---|---|---|---|
| 1,427,849 | 9/1922 | Rayder . | |
| 4,953,767 | 9/1990 | Bennett | 224/192 |
| 5,445,303 | 8/1995 | Cawile, Jr. | 224/222 |
| 5,611,164 | 3/1997 | Rassias | 42/70.11 |
| 5,653,367 | 8/1997 | Abramson | 224/581 |
| 5,768,816 | 6/1998 | Rassias | 42/70.11 |

FOREIGN PATENT DOCUMENTS 2256700 12/1992 United Kingdom .

*Primary Examiner*—Stephen P. Garbe
*Attorney, Agent, or Firm*—Webb Ziesenheim Logsdon Orkin & Hanson, P.C.

[57] ABSTRACT

A leg holster for a firearm has a holster plate engaged on a horizontal retaining belt. A firearm locking assembly mounting site is defined in a central retaining portion of the holster plate and at least one vertical retaining belt is secured to the horizontal retaining belt adjacent an inboard side of the holster plate. Hook and loop closures may be utilized to secure the vertical retaining belt onto the inboard side of the holster plate. A shoulder holster is also disclosed having a holster plate engaged at an upper end of the plate to a shoulder strap and at a lower end of the plate to a vertical control strap. The shoulder strap is adapted to engage a shoulder of a wearer. The vertical control strap is engageable with a waist belt of the wearer at an end of the vertical control strap opposite the holster plate.

24 Claims, 4 Drawing Sheets

SECURITY AND DEPLOYMENT SYSTEM

This patent application is related to and claims priority from U.S. Provisional Application No. 60/030,132, filed Nov. 4, 1996.

BACKGROUND OF THE INVENTION

1. Field of the Invention

This invention is related to holsters for carrying firearms and, more particularly, to leg holsters and shoulder holsters.

2. Description of Prior Art

Certain firearm users, such as tactical units of the Drug Enforcement Agency, the FBI, the Bureau of Alcohol Tobacco and Firearms, military, paramilitary and SWAT units, as well as other units, prefer or require that their members carry their sidearms holstered and strapped to their thighs and not on their duty bells (i.e., waist belts). Many of these high intensity tactical units are engaged in repelling or using ladders while wearing thick body armor, as well as other physical motions which would limit their ready access to their sidearms if carried in a holster attached to a waist duty belt.

Recently, an agent of the Bureau of Alcohol Tobacco and Firearms (BATF) was ascending a ladder on a particular raid and shot himself in the right leg when he tried to withdraw his loaded and cocked pistol from a conventional thigh holster. In slow motion analysis of the incident, it became apparent that the agent tried to check that his pistol was still within the holster. Once his hand went around the grip, the agent's finger touched the trigger causing it to fire. This accident could have been avoided had the agent been wearing a sidearm holster which provided:

(1) The weapon would not be cocked or loaded with a round in battery;

(2) Pulling on the grip of the pistol would not load, cock or allow the weapon to be removed from the holster; and (3) Touching the trigger would not activate it.

Furthermore, it would be advantageous to provide a sidearm holster such that the holster can be worn on either side of the waist, or in an ambidextrous cross draw mode, in an ambidextrous shoulder holster mode, or in an ambidextrous leg holster mode by simply rearranging the components of the holster without the necessity of manufacturing separate components for right hand and left hand wearing of the holster.

It is therefore an object of the present invention to provide a leg holster and a shoulder holster which may be worn in a right hand or left hand configuration, with no need to manufacture separate components to meet this requirement. It is a further object to provide such a leg or shoulder holster which is not subject to shifting or riding up on the wearer, despite the wearer engaging in intense physical activities.

SUMMARY OF THE INVENTION

I have therefore invented a leg holster for a firearm having a holster plate with a first end, a second end and a central portion. The holster plate has an inboard side and an outboard side, and the holster is engaged on a horizontal retaining belt. A firearm locking assembly mounting site is defined on the central portion of the holster plate on the outboard side thereof. At least one vertical retaining belt is secured to the horizontal retaining belt adjacent the inboard side of the holster plate. The vertical retaining belt is removably securable to a waist belt of a wearer.

The leg holster may include hook or loop closure means positioned on the inboard side of the holster plate. The vertical retaining belt has on a first end thereof the other of the hook or loop closure means so that the first. end of the vertical retaining belt is removably securable to the inboard side of the holster plate. Most preferably, the leg holster includes two vertical retaining belts, each secured by the hook and loop closure means (e.g., VELCRO) to the inboard side of the holster plate.

The firearm locking assembly mounting site may comprise at least one bore in the central portion of the holster plate for receiving a bolt fastener to secure the firearm locking assembly to the holster plate. Most preferably, the leg holster includes at least three bores vertically aligned in a central portion of the holster plate for this purpose.

The inboard side of the holster plate is preferably formed with a concave surface.

The invention also includes a shoulder holster having a holster plate with an upper end and a lower end. The holster plate has an inboard side and an outboard side and is engaged at the upper end to a shoulder strap. The holster plate is engaged at its lower end to a vertical control strap. A firearm locking assembly mounting site is defined in a central portion of the holster plate on the outboard side thereof. The shoulder strap is adapted to engage a shoulder of a wearer. The vertical control stran is engageable with a waist belt of the wearer.

The firearm locking assembly mounting site comprises at least one bore in the central portion of the holster plate for receiving a bolt fastener to secure the locking assembly to the holster plate. Most preferably, the shoulder holster includes nine bores arranged in a 3 by 3 matrix, the bores positioned equidistant from one another. The firearm locking assembly may thus be secured horizontally or at an inclined position on the holster plate.

Further details and advantages of the invention may be seen from the following detailed description, in connection with the drawings, wherein like reference numerals represent like parts. dr

DETAILED DESCRIPTION OF THE PREFERRED EMBODIMENTS

Figure 1:
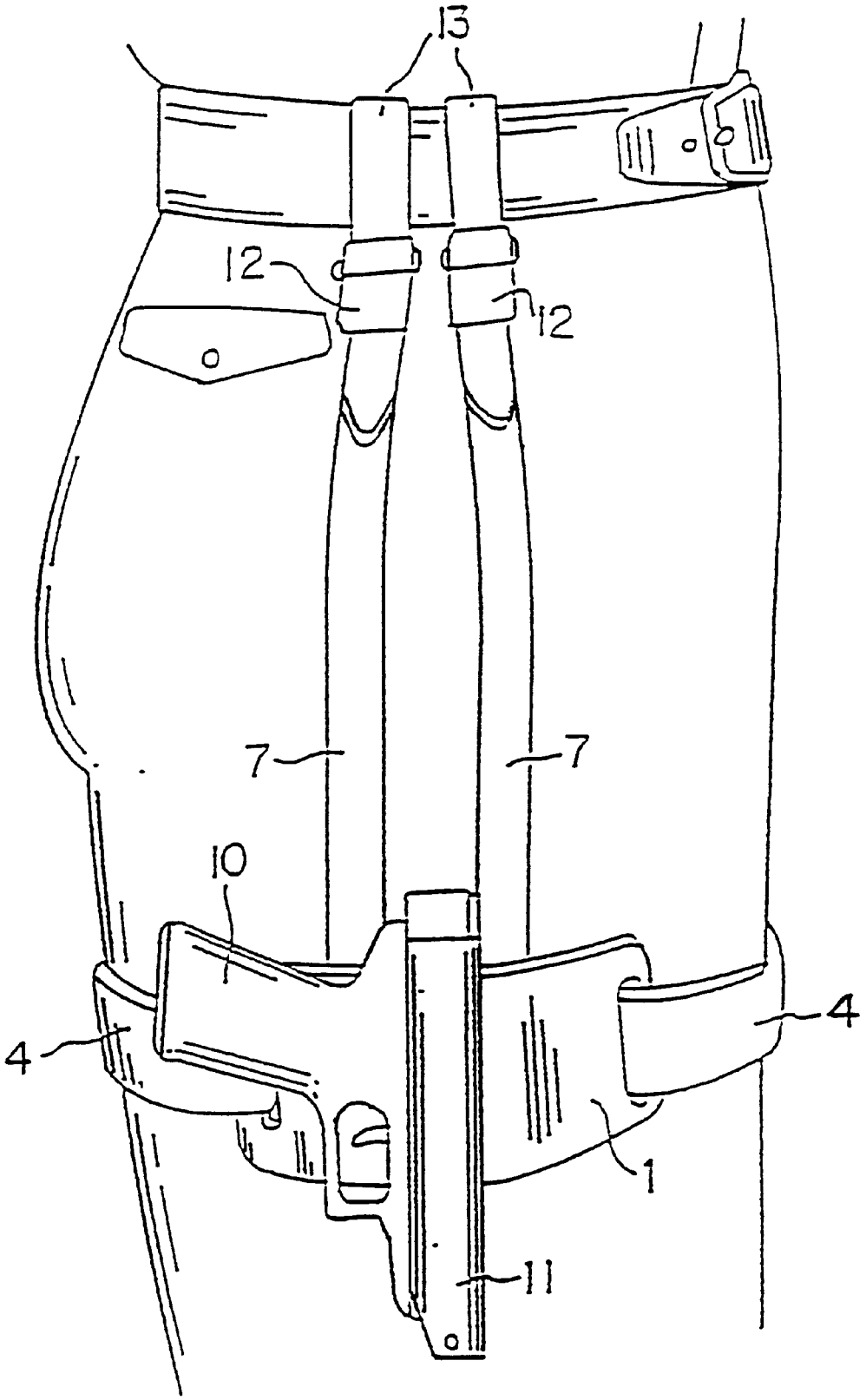
FIG. 1 is a side elevation view of a wearer having a leg holster according to the present invention.

FIG. 1 shows a leg holster secured to the thigh of a wearer, according to the first embodiment of the invention. The leg holster has a holster plate 1 engaged on a horizontal retaining belt 4. Two vertical retaining belts 7 extend between the horizontal retaining belt 4 and a waist duty belt on the wearer. Particularly, loops 13 on the upper ends of the vertical retaining belts receive the wearer's waist duty belt, and hang therefrom. The vertical retaining belts are equipped with quick release, length adjusting fasteners 12, which may be one of many different varieties, well known to those skilled in the art.

A firearm locking assembly 11, carrying a semiautomatic pistol 10, is vertically mounted in a central portion of the outboard side of the holster plate 1.

Figure 2:
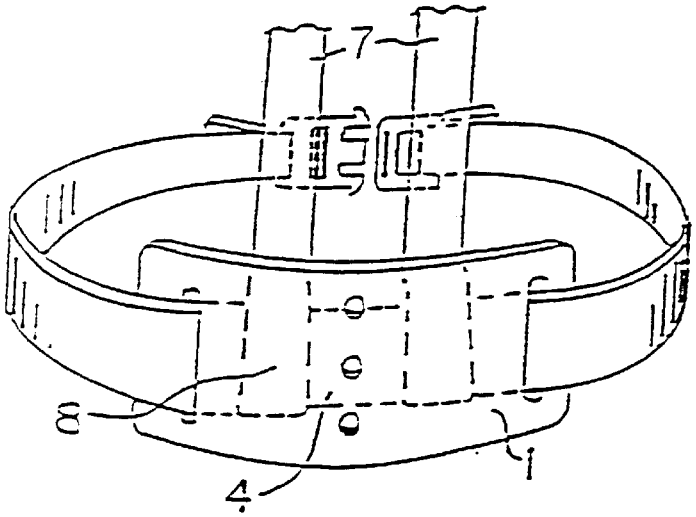
FIG. 2 is a side view showing the outboard side of a holster plate, a horizontal retaining belt and two vertical retaining belts according to the leg holster of the present invention.

Referring to FIG. 2, the interconnection between vertical retaining belts 7 and horizontal retaining belt 4 is illustrated in phantom. Particularly, the vertical retaining belts 7 have loops 8 which receive the horizontal retaining belt 4 adjacent the inboard side of the holster plate 1. Alternatively, the vertical retaining belts could be integrally manufactured with the horizontal retaining belt. Both the horizontal retaining belt 4 and vertical retaining belts 7 are preferably made from a nylon web material, well known to those skilled in the art for the purpose of making belt or strapping products.

Figure 3:
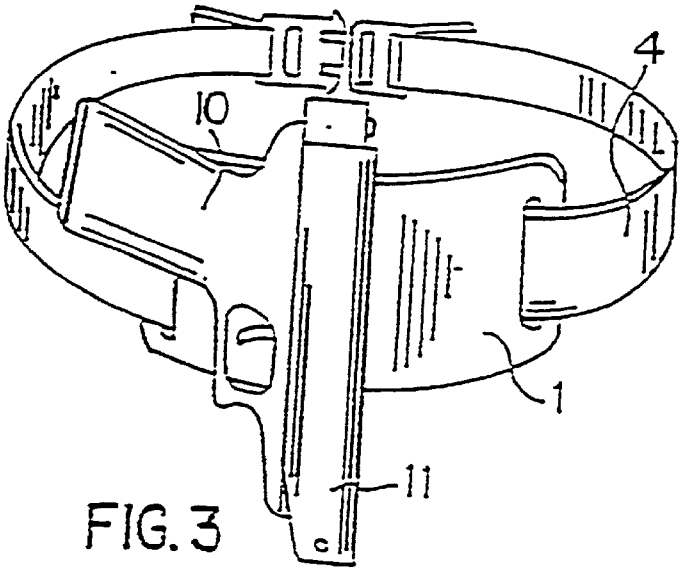
FIG. 3 is a side view showing a firearm locking assembly mounted on a holster plate on the leg holster of the present invention.

FIG. 3 shows the holster plate 1 on horizontal retaining belt 4, illustrating that, by virtue of the loops 8, the vertical retaining belts 7 may be removed from the horizontal retaining belt 4 and the holster may thus be adapted for carrying the pistol 10 and firearm locking assembly 11 around the waist.

Figure 4:
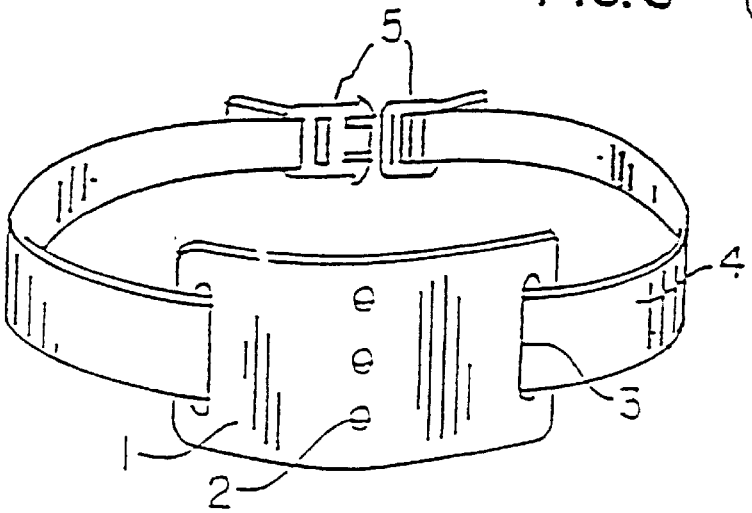
FIG. 4 is a side view showing the holster plate and horizontal retaining belt of a leg holster according to the invention.
Figure 5:
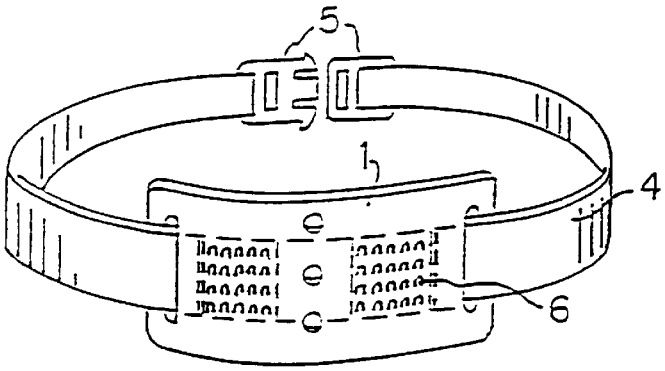
FIG. 5 is a side view of the holster plate and horizontal retaining belt of a leg holster according to the invention, further showing in phantom two areas of VELCRO positioned on an inboard side or the holster plate.
Figure 6:
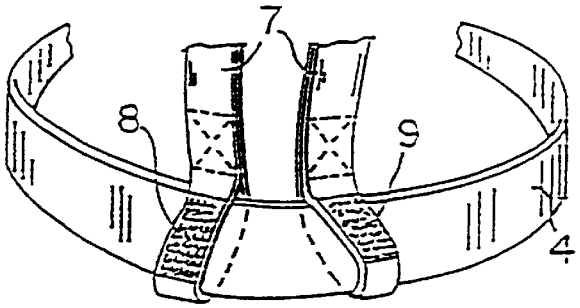
FIG. 6 is a side view, partially broken away, showing two vertical retaining belts, each retaining belt having a loop which receives the horizontal retaining belt according to the invention.

FIGS. 4–6 are isolation views showing the various components of the leg holster according to the invention. FIG. 4 illustrates the slots 3 located at opposite ends of the holster plate 1, which slots receive the horizontal retaining belt 4 and secure the holster plate on the belt. Nylon quick release length adjusting fasteners 5, a male fastener shown on the left and a female fastener shown on the right, are positioned at the free ends of the horizontal retaining belt 4 as is well known in connection with the belting and strapping arts. The nylon fasteners 5 provide for length adjustment of the horizontal belt 4, in a known manner. Fasteners 5 are snapped together by the wearer to secure horizontal retaining belt 4 around the thigh of the wearer, as shown in FIG. 1.

Holster plate 1 has located in the central portion thereof three vertically aligned bores 2 which define a mounting site for the firearm locking assembly. Particularly, the bores 2 receive bolt fasteners which extend through the bores and into the firearm locking assembly 11 to secure the firearm locking assembly to the holster plate.

Referring to FIG. 5, male VELCRO 6 (generically known as hook and loop closure means) is affixed to the inboard side of the holster plate 1 on either side of the vertically aligned bores 2, between the bores 2 and the slots 3. The VELCRO 6 may be secured by adhesive or similar means to the inboard side of the holster plate 1. The term "inboard side" is meant to refer to the side of the holster plate 1 which engages the wearer's body, whereas "outboard side" refers to the outward facing side of the holster plate.

Loops 8, shown in FIG. 6, are equipped with corresponding female VELCRO 9 on the outer surfaces of the loops. Thus, when the vertical retaining straps 7 are in position, they may be secured to the inboard side of the holster plate 1 by virtue of the fact that the loops 8 are compressed against the male VELCRO 6 affixed to the inboard side of the holster plate. This insures that the leg holster is not only adjustably positioned vertically but also restricts lateral movement of the holster plate to avoid shifting during use or riding up (or down) on the wearer's leg.

The firearm locking assembly 11 contains threaded bores (not shown) which receive the bolt fasteners that extend through bores 2 in holster plate 1. The firearm locking assembly 11 may take one of many forms but is preferably according to the firearm locking assembly disclosed and claimed in my U.S. Pat. No. 5,611,164 or U.S. Pat. No. 5,768,816 both incorporated herein by reference. It will be apparent to those skilled in the art that the leg holster of the present invention will be useful with other firearm locking assemblies and holsters currently available in the art.

The height of the leg holster is adjusted by manipulation of the length adjusting fasteners 12 of the vertical retaining belts 7, to suit the comfort of the wearer. The length of the horizontal retaining belt 4 may be adjusted via quick release, length adjusting fasteners 5 to tailor the belt 4 to the circumference of the wearer's leg.

The leg holster is useful in an ambidextrous fashion by adjusting the belts 4, 7 and the position of the firearm locking assembly 11 on holster plate 1. The leg holster can also be used in a straight draw or cross draw mode.

Figure 7:
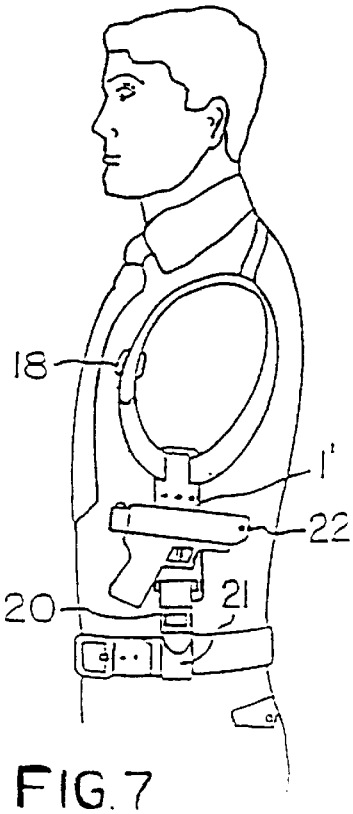
FIG. 7 is a side elevation view showing a shoulder holster on a wearer with a firearm locking assembly horizontally mounted on the shoulder holster, according to the invention.
Figure 8:
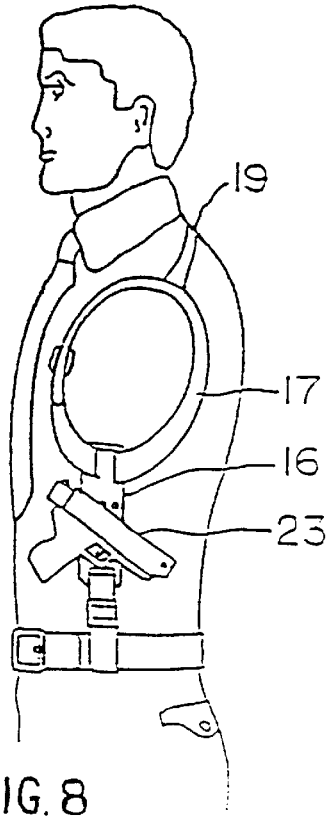
FIG. 8 is a side view showing a shoulder holster on a wearer with a firearm locking assembly mounted in an inclined position on the shoulder holster, according to the invention.

Referring to FIGS. 7 and 8, a shoulder holster according to a second embodiment of the invention is disclosed. The shoulder holster has a holster plate 1' having a matrix 16 of bores 2 in a central portion of the holster plate 1'. The matrix 16, which measures 3 by 3 bores in dimension, and in which all adjacent bores 2 are spaced equidistant from one another, defines a firearm locking assembly mounting site in a central portion of the holster plate 1'.

The holster plate 1' has a shoulder strap 17 engaged on an upper end of the holster plate 1' with a vertical control strap 20 engaged on a lower end of the holster plate 1'. The shoulder strap 17 is adapted to encircle the shoulder of the wearer. The shoulder strap 17 is equipped with quick release, length adjusting fastener 18, as described in connection with fastener 5, above. A back strap 19 may also be utilized to hold the shoulder strap 17 in position on top of the wearer's shoulder, as is well known in the art.

Vertical control strap 20 is also provided with quick release, length adjusting fastener means, as described in connection with shoulder strap 17. Vertical control strap 20 has a loop 21 which receives a waist duty belt of the wearer.

Figure 9:
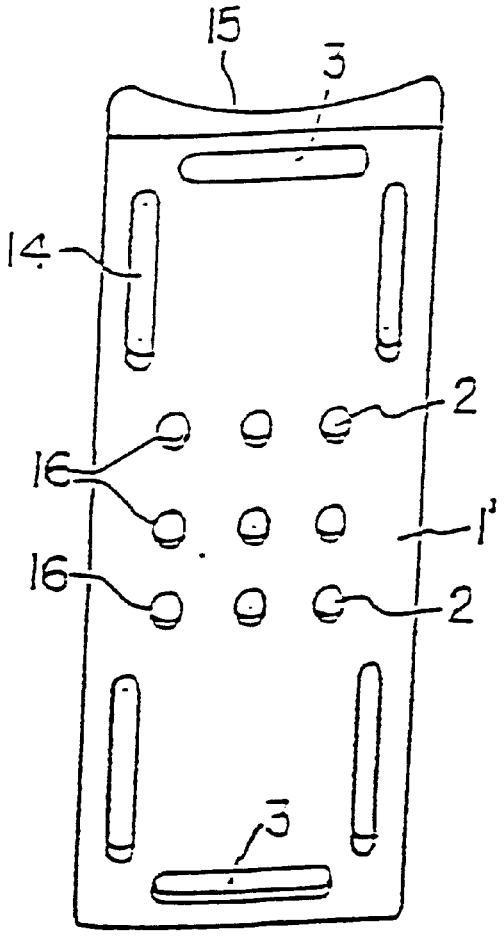
FIG. 9 is a side view of a holster plate for a shoulder holster according to the invention.
Figure 10:
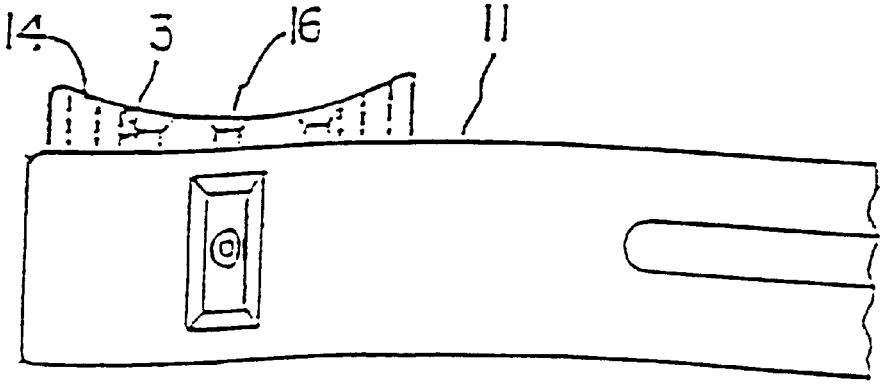
FIG. 10 is a top view of a firearm locking assembly horizontally mounted on a holster plate, forming a part of the shoulder holster of the present invention.

Referring to FIG. 9, the holster plate 1' has slots 3 at its upper and lower ends and further has slots 14 positioned along the lateral edges of the holster plate 1' adjacent the upper and lower ends of the holster plate. Holster plate 1' has a concave surface 15 defined on the inboard side of the holster 1', as shown in FIGS. 9 and 10. The concave surface 15 provides for contouring of the holster plate 1' to enhance the comfort and fit of the plate against the wearer's torso.

FIG. 7 shows a horizontally mounted firearm locking assembly 22, while FIG. 8 shows a firearm locking assembly mounted in an inclined position 23. This capability is provided by the matrix 16 of bores 2. For example, in FIG. 7, the bolt fasteners are placed through the central horizontal row of bores 2 in matrix 16 to secure the firearm locking assembly to the holster plate 1'. In FIG. 8, the bolt fasteners are secured in the upper left hole, middle hole and lower right hole so that the pistol is at an angle of approximately 450°.

As shown in FIGS. 7 and 8, the pistol 10 is in a right hand, cross draw configuration. However, with a simple adjustment of the holster plate 1' to the right body side of the wearer, and corresponding adjustments of the shoulder strap 17 and vertical control strap 20, the pistol can now be secured with the shoulder holster in the left hand cross draw configuration, without any need to, manufacture separate left and right hand parts or belting. The shoulder holster is thus completely capable of ambidextrous utilization.

Having described the presently preferred and best known modes for practicing the invention, it will be apparent to those skilled in the art, upon reading the above-detailed description, that certain modifications may be made without departing from the spirit and scope of the invention. It is thus not intended to limit the invention except as set forth in the following claims.

I claim:

1. A leg holster for a firearm, comprising:

a holster plate having a first end, a second end and a central portion, said holster plate having an inboard side and an outboard side;

said holster plate engaged on a horizontal retaining belt;

a firearm locking assembly mounting site defined on the central portion of said holster plate on the outboard side thereof;

at least one vertical retaining belt, a first end of which is secured to said horizontal retaining belt adjacent the inboard side of said holster plate;

a second end of said vertical retaining belt removably securable to a waist belt of a wearer; and one of hook or loop closure means positioned on the inboard side of said holster plate, said vertical retaining belt having on the first end thereof the other of said hook or loop closure means so that said first end of said vertical retaining belt is removably securable to the inboard side of said holster plate.

2. The leg holster of claim 1 including two vertical retaining belts.

3. The leg holster of claim 1 wherein said firearm locking assembly mounting site comprises at least one bore in the central portion of said holster plate for receiving a bolt fastener to secure said firearm locking assembly to said holster plate.

4. The leg holster of claim 3 including at least three bores, said three bores aligned vertically in the central portion of said holster plate.

5. The leg holster of claim 1 wherein one of said hook or loop closure means is located on the inboard side of said holster plate between said central portion and said first and second ends of said holster plate, said holster further comprising two vertical retaining belts, the first ends of said vertical retaining belts having the other of said hook or loop closure means thereon so that they are removably securable to the inboard side of said holster plate.

6. The leg holster of claim 1 including male and female quick release, length adjusting fasteners on first and second ends of said horizontal retaining belt.

7. The leg holster of claim 1 wherein said first end of the vertical retaining belt comprises a loop which receives said horizontal retaining belt.

8. The leg holster of claim 1 including a quick release, length adjusting fastener on the second end of the vertical retaining belt, said second end of the vertical retaining belt further comprising a loop which may receive the waist belt of the wearer.

9. The leg holster of claim 1 further including a firearm locking assembly mounted on the central portion of said holster plate.

10. The leg holster of claim 1 wherein the inboard side of said holster plate defines a concave surface.

11. The leg holster of claim 1 including two slots, located at said first and second ends of said holster plate, respectively, said slots receiving said horizontal retaining belt.

12. A leg holster for a firearm, comprising:

a holster plate having a first end, a second end and a central portion, said holster plate having an inboard side and an outboard side;

said holster plate engaged on a horizontal retaining belt;

means for securing a firearm locking assembly to said central portion of said holster plate on the outboard side thereof;

one of hook or loop closure means positioned on the inboard side of said holster plate; and at least one vertical retaining belt, a first end of which has positioned thereon the other of said hook or loop closure means so that said first end of said vertical retaining belt is removably securable to the inboard side of said holster plate wherein said first end of the vertical retaining belt comprises a loop which receives said horizontal retaining belt;

a second end of said vertical retaining belt removably securable to a waist belt of a wearer.

13. The leg holster of claim 12 wherein said means for securing a firearm locking assembly comprises at least one bore in the central portion of said holster plate for receiving a bolt fastener to secure said firearm locking assembly to said holster plate.

14. The leg holster of claim 13 including at least three bores, said three bores aligned vertically in the central portion of said holster plate.

15. The leg holster of claim 12 wherein one of said hook or loop closure means is located on the inboard side of said holster plate between said central portion and said first and second ends of said holster plate, said holster further comprising two vertical retaining belts, the first ends of said vertical retaining belts having the other of said hook or loop closure means thereon so that they are removably securable to the inboard side of said holster plate.

16. In combination a shoulder holster and a locking assembly for a firearm, the firearm having a firing chamber, a barrel with a barrel face and a muzzle end, and a slide element, the combination shoulder holster and firearm comprising:

a holster plate having an upper end and a lower end with an inboard side and an outboard side;

said holster plate engaged at said upper end to a shoulder strap and at said lower end to a vertical control strap;

said shoulder strap adapted to engage a shoulder of a wearer;

said vertical control strap engageable with a waist belt of a wearer at an end of the vertical control strap opposite said holster plate; and a firearm locking assembly mounted in a central portion of said holster plate on the outboard side thereof, said locking assembly comprising:

a slide shield;

an action locking arm carrying a lug, said lug receivable in the firing chamber and the barrel face of the firearm, said action locking arm attached to and positioned within said slide shield; and a slide block attached to said slide shield and spaced from said action locking arm and lug, said slide block having a barrel port for passage of the muzzle end of said barrel therethrough;

whereby when said lug is received in said firing chamber and said barrel face, said muzzle end of said barrel is received in said barrel port and said slide element is in contact with said slide block, said firearm is retained in said locking assembly.

17. The shoulder holster of claim 16 wherein the inboard side of said holster plate defines a concave surface.

18. The shoulder holster of claim 16 wherein said holster plate includes a firearm locking assembly mounting site comprising at least one bore in the central portion of the holster plate for receiving a bolt fastener to secure the locking assembly to the holster plate.

19. The shoulder holster of claim 18 including nine bores arranged in a matrix which is three bores wide and three bores tall, said bores positioned equidistant from one another.

20. The shoulder holster of claim 16 wherein said vertical control strap defines a loop which may receive the waist belt of the wearer.

21. The shoulder holster of claim 16 wherein said vertical control strap and said shoulder strap each have quick release, length adjusting fasteners for removably securing the straps on the wearer.

22. The shoulder holster of claim 16 wherein said firearm locking assembly is horizontally mounted in the central portion of said holster plate.

23. The shoulder holster of claim 16 wherein said firearm locking assembly is mounted in the central portion of said holster plate at an inclined position.

24. The shoulder holster of claim 16 further including slots in said holster plate for receiving said shoulder strap and said vertical control strap.

* * * * *

UNITED STATES PATENT AND TRADEMARK OFFICE

CERTIFICATE OF CORRECTION

PATENT NO. : 6,149,042
DATED : November 21, 2000
INVENTOR(S) : John N. Rassias

It is certified that error appears in the above-identified patent and that said Letters Patent is hereby corrected as shown below:

Column 1 Line 18 "duty bells" should read --duty belts--.

Column 2 Line 4 between "first" and "end" delete period (.).

Column 2 Line 25 "control stran" should read --control strap--.

Column 2 Line 38 after "parts." delete "dr".

Column 5 Line 3 "450°" should read --45°--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*